US005968419A

United States Patent [19]

Sadhir et al.

[11] Patent Number: 5,968,419

[45] Date of Patent: Oct. 19, 1999

[54] CONDUCTIVE POLYMER COMPOSITIONS, ELECTRICAL DEVICES AND METHODS OF MAKING

[75] Inventors: Rajender K. Sadhir; Howard E. Saudners; Karl F. Schoch, Jr., all of Pittsburgh; James D. B. Smith, Monroeville, all of Pa.

[73] Assignee: Westinghouse Electric Company LLC, Pittsburgh, Pa.

[21] Appl. No.: 08/986,889

[22] Filed: Dec. 8, 1997

[51] Int. Cl.[6] ..... H01B 1/20; H01B 1/22; H01B 1/24

[52] U.S. Cl. ..... 252/512; 252/500; 252/511

[58] Field of Search ..... 252/500, 511, 252/512, 518.1

[56] References Cited

U.S. PATENT DOCUMENTS

| | | | |
|---|---|---|---|
| 4,137,275 | 1/1979 | Smith et al. | 260/830 |
| 4,204,181 | 5/1980 | Smith et al. | 336/96 |
| 4,545,926 | 10/1985 | Fouts, Jr. et al. | 252/511 |
| 4,575,432 | 3/1986 | Lin et al. | 252/511 |
| 4,581,158 | 4/1986 | Lin | 252/511 |
| 4,658,121 | 4/1987 | Horsma et al. | 219/553 |
| 4,775,778 | 10/1988 | van Konynenburg et al. | 219/549 |
| 4,824,871 | 4/1989 | Shinomura | 521/53 |
| 4,907,340 | 3/1990 | Fang et al. | 29/610.1 |
| 4,910,389 | 3/1990 | Sherman et al. | 219/598 |
| 4,951,384 | 8/1990 | Jacobs et al. | 29/611 |
| 4,966,729 | 10/1990 | Carmona et al. | 252/511 |
| 5,250,228 | 10/1993 | Baigrie et al. | 252/511 |
| 5,414,403 | 5/1995 | Greuter et al. | 338/22 R |
| 5,614,881 | 3/1997 | Duggal et al. | 338/22 R |

FOREIGN PATENT DOCUMENTS

WO 96/41354 12/1996 WIPO .

*Primary Examiner*—Mark Kopec

[57] ABSTRACT

The present invention is directed to conductive polymer composition that have positive temperature coefficients, electrical devices comprised thereof and methods of making the same. The composition comprises a thermoset polymer matrix containing discretely distributed thermoplastic material and dispersed conductive material. Preferably, the thermoset and thermoplastic polymers are substantially immiscible and have comparable volume transition temperatures, such as bisphenol A liquid epoxy resins and oxidized polyethylene.

18 Claims, 5 Drawing Sheets

CONDUCTIVE POLYMER COMPOSITIONS, ELECTRICAL DEVICES AND METHODS OF MAKING

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

The present invention is directed generally to electrically conductive polymer compositions and electrical devices comprised thereof. More particularly, the invention is directed to electrically conductive thermoset polymer compositions that contain substantially discrete distributed thermoplastic polymers and electrically conductive particles and exhibit positive temperature coefficients for use in current limiting devices and other electrical applications.

Conductive polymer compositions are finding increasingly widespread use in electrical applications because conductive polymer have desirable properties, such as the solid state characteristics and positive temperature coefficient (PTC) behavior. Generally, a material is said to have a positive temperature coefficient if the electrical resistance of a material increases with temperature.

Certain PTC materials exhibit an exponential rise in the resistivity of the material above a given temperature. Conductive polymers that exhibit this type of PTC behavior have been used in current limiting circuit protection, circuit breaker, applications for a variety of electrical devices, such as motors, solenoids, phone lines, and batteries. When a short circuit or a fault occurs causing a rise in the line current, IR resistive heating will cause a temperature rise in the polymer. The sudden rise in the polymer temperature will trigger a sudden increase in the polymer resistivity that will in effect "trip the circuit" by limiting the flow of current. Conductive polymer circuit breakers are advantageous because, when the excess voltage and current diminishes, the conductive polymer will again have a lower resistivity upon cooling. Therefore, unlike manual circuit breakers and fuses, the conductive polymer circuit breakers do not have to be reset or replaced each time the circuit is tripped.

Conductive polymers that exhibit exponential PTC behavior have been traditionally made by dispersing a conductive material in a crystalline polymer. In crystalline conductive polymers, the temperature at which the polymer switches from a low resistivity to a high resistivity, called the switching temperature, $T_s$, is associated with the breakdown of the crystalline structure near the melting point of the polymer. A disadvantage of crystalline conductive polymers is that the switching temperature is governed by the physical properties of the polymer and can not be made specific to the desired application.

Alternatively, amorphous and semi-crystalline polymers, such as elastomers, thermoplastics and thermosets have been crosslinked to produce polymers that exhibit PTC behavior analogous to the crystalline polymer compositions. Crosslinking is usually accomplished by chemical treatment or by irradiation of the polymer. The temperature at which the crosslinking was performed determines the switching temperature of the resultant conductive polymer composition. Conductive polymers in which PTC behavior is produced by crosslinking have increased application as a result of the ability to control the switching temperature of the conductive polymer.

However, elastomers and thermoplastics typically have limited thermal and electrical resistance stability when exposed to thermal cycling, such as in current limiting applications. Whereas, thermoset polymer devices provide increased thermal stability, but the thermoset polymers having a high conductive material loading generally do not exhibit PTC effects that are necessary for current limiting applications.

Additionally, blended polymer compositions have been used to produce conductive polymer compositions that have PTC characteristics. For example, U.S. Pat. No. 5,250,228 (Baigrie et. al.) discloses compositions that have conductive material dispersed in a mutually soluble mixture of an essentially amorphous thermoplastic and a liquid thermoset polymer. The miscible polymer mixtures provide for increased conductive material loadings compared to prior thermoset polymer compositions, combined with increased thermal stability over compositions utilizing only thermoplastic polymers.

A disadvantage of these materials are that the polymers used in the material are limited to miscible polymers. Also, while the addition of a thermoset to the matrix material provides some degree of increased stability compared to a pure, essentially amorphous thermoplastic matrix material, the material remains relatively unsuitable for high temperature and current limiting applications. In addition, the low temperature resistance of these materials tends to increase with successive thermal cycles, known as "ratcheting", unless strict processing controls are followed.

Thus, it is apparent that the conductive polymer compositions currently available do not provide the versatility and durability required to become a viable alternative to mechanical circuit breakers in the industry. Accordingly, there is a need for conductive polymer compositions that are thermally stable and can be processed to have PTC characteristics in both high and low resistance devices and applications in a cost effective manner.

BRIEF SUMMARY OF THE INVENTION

The present invention is directed to electrically conductive polymer compositions and electrical devices comprised thereof that provide thermally stable PTC performance in high and low resistance applications. The compositions include a polymer matrix having a volume transition temperature and including at least one thermoset polymer. The polymer matrix contains substantially discretely distributed thermoplastic material having a volume transition temperature and also dispersed electrically conductive material. Preferably, the polymer matrix and the thermoplastic material are substantially immiscible and the respective volume transition temperatures of each are substantially equal.

The polymer matrix may also include additives, such as chemical crosslinking agents, arc controlling materials, reaction controlling materials and materials to alter the thermal conductivity of the composition, depending on the particular application. The compositions can be used in electrical devices by providing electrical contact with a component formed from the composition. One or more of the components can be incorporated in a circuit, such as a protection circuit for limiting the current to equipment, such as motors, etc., or other loads during an overload condition.

The present invention is also directed to methods for making the conductive polymer compositions. The methods involve discretely distributing thermoplastic material in a polymer matrix comprising at least one thermoset polymer and also dispersing conductive material in the matrix to form the conductive polymer composition. The conductive polymer composition can be further processed to produce components for use in a variety of applications. The components are generally produced by forming, or melting and forming if solid, the composition in a desired shape, preferably crosslinking the matrix, and curing the composition to produce the component. In addition, electrical contacts can be attached to the component either before or after the composition is cured to allow the component to be incorporated into an electrical circuit.

The present invention provides for thermally stable conductive polymer compositions that are capable of high conductive material loadings and presents an alternative to the use of manual circuit breakers and fuses in indusry. The conductive polymer compositions of the present invention exhibits positive temperature coefficient (PTC) behavior and can be processed to suit a variety of applications including both high and low voltage device applications. These and other advantages will become apparent from the following detailed description.

BRIEF DESCRIPTION OF THE DRAWINGS

The present invention will be described, by way of example only, in the following detailed description, when read in conjunction with the appended drawings, in which.

DETAILED DESCRIPTION OF THE INVENTION

The present invention is directed to conductive thermoset polymer compositions, electrical devices comprised thereof and methods of making the compositions. The compositions include a polymer matrix having a volume transition temperature, i.e. a temperature at which there is an abrupt change in volume, and composed of at least one thermosetting polymer. The compositions also include thermoplastic material that has a volume transition temperature preferably approximately equal to that of the matrix and is substantially discretely distributed in the matrix, and conductive material dispersed in the matrix.

Figure 1:
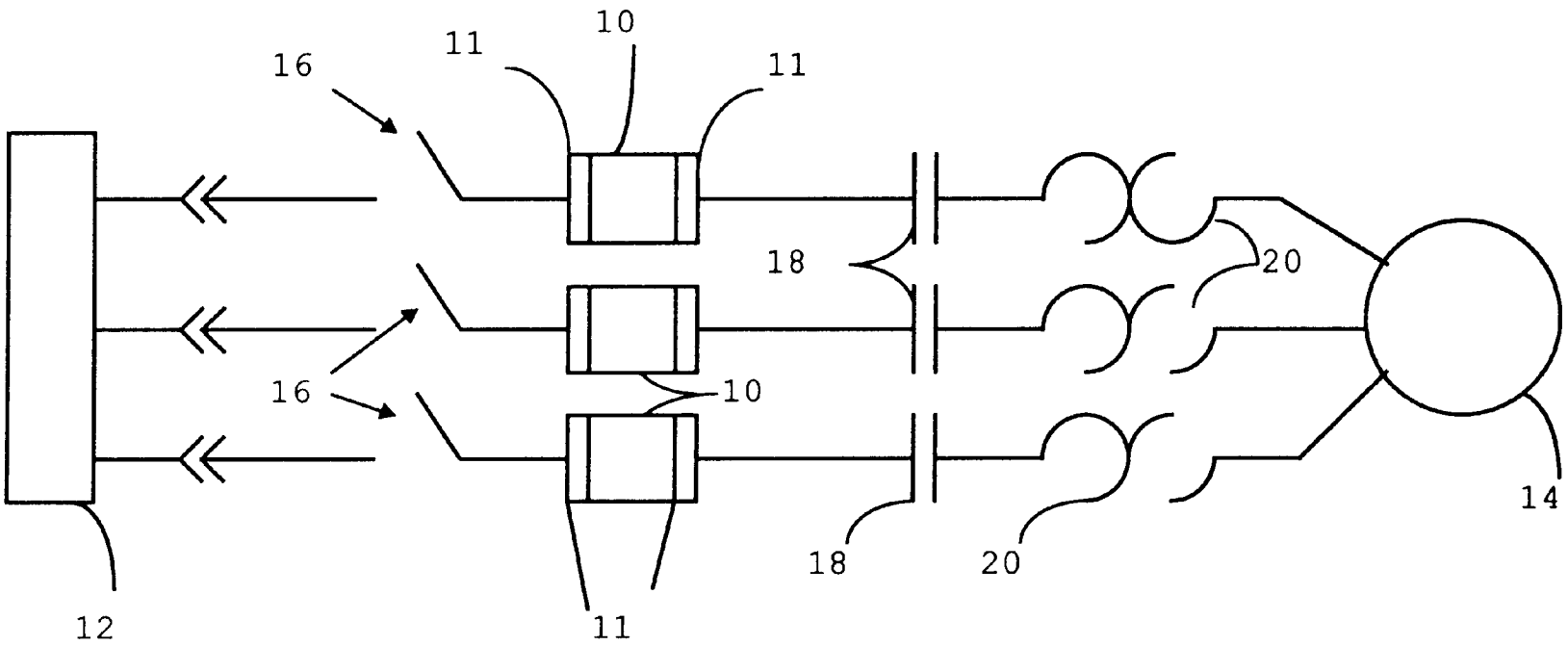
FIG. 1 is a schematic circuit incorporating a conductive polymer circuit breaker of the present invention.

The compositions can be used to form electrical components 10 that can be provided with electrical contacts, or leads, 11 for connection to an external circuit, such as shown in FIG. 1. The component 10 is shown in a three phase circuit between a current source 12 and a load 14, such as a motor. The component 10 serves as a current limiting device, or circuit breaker, to protect the load 14 from current spikes from the source 12. Typically, the circuit will also contain switches 16, contactors 18, and overload relays 20. Thermoset polymers that are suitable for use as a matrix in the present invention will necessarily depend upon the end use of a component made from the composition.

For example, components that will be used in high voltage current limiting applications will require matrix material that has a higher thermal stability than materials for use in low voltage applications. In addition, a suitable thermoplastic material that can be discretely distributed in the matrix material should be selected for use in the composition.

The matrix material should undergo a distinct volume transition, preferably a 2% increase or more, at a temperature that can be achieved as a result of resistive heating ($I^2R$) of the composition. Distinct volume transitions occur in a number of different ways, including (1) phase change, (2) crystalline to amorphous structure transition, and (3) amorphous to amorphous glass transition or softening. A distinct volume transition will cause differential expansion between the dispersed conductive material and the matrix. The polymer expansion will tend to separate and electrically isolate the conductive material in the expanded polymer matrix. When the composition is embodied in an electrical component, the separation of the conductive material will significantly increase the resistance of the component, thereby decreasing the current through the component.

Generally, thermosetting polymers, such as epoxy resins, polyimides, unsaturated polyesters, silicones, polyurethanes, phenolic resins, cyanate esters or combinations thereof, that have the aforementioned characteristics are suitable to practice the invention. Epoxy resins are preferably used to produce the thermoset polymer, and most preferably epoxy resins containing bisphenol A groupings, such as those described in U.S. Pat. Nos. 4,137,275 and 4,204,181 issued to Smith, which are incorporated herein by reference. Preferred epoxy resins are prepared using a diglycidylether of bisphenol A having an epoxy equivalent weight of 170–180 and a viscosity of 4,000–6,000 cps at 25° C. (a typical example of a suitable commercial material is DER-332 from Dow Chemical Corp.) and a diglycidylether of neopentylglycol. The compositions made using the preferred liquid epoxy resin have a transition temperature in the range of 120–150° C. depending on the particular ratio of curing agent/accelerator to epoxy and the curing conditions.

The thermoplastic material of the present invention has a volume transition temperature, preferably near the volume transition temperature of the matrix. The volume transition temperature can alternatively be substantially greater or less than volume transition temperature of the matrix. The disparity in volume transition temperatures could provide a two step PTC effect, as opposed a single step increase that occurs when the volume transition temperatures of the thermoplastic and matrix are comparable. The alternative two step embodiment may be useful in an application where it is desirable to moderate the current limiting stages. However, variations in the performance of the alternative embodiments may be severe due to separation of the components as a result of densities differences that occur when one material expands at its volume transition temperature, while the other material does not expand.

Preferably, a generally immiscible thermoplastic material is used to ensure that the thermoplastic material will remain discrete from the matrix material over time. Also, it is believed that if the thermoplastic material in its discrete form is chemically bonded with the thermoset during curing, additional stability may be added to the discrete structure of composition.

Alternatively, discrete forms of otherwise miscible thermoplastic and matrix materials or blends can be used in the present invention. However, it is believed that the use of discrete miscible thermoplastics may result in wide performance variations in the compositions due to dissolution of the discrete miscible thermoplastic material in the matrix over time, and/or after a switching event.

It is also preferred that the thermoplastic material generally has a low conductivity and does not include conductive material. The expansion of the thermoplastic not containing conductive material at its volume transition temperature serves to further separate and isolate the conductive material in the matrix; thereby further increasing the resistance of the composition. One skilled in the art will appreciate that semiconductive materials or varying amounts of conductive materials can be added to the thermoplastic material to bring about a desired electrical property in the composition.

In a preferred embodiment, substantially crystalline oxidized polyethylene (o-PE) is discretely distributed in the form of solid particles mixed with the liquid thermoset and dispersed conductive material. The oxidized polyethylene preferably does not include filler or conductive material. The oxidized polyethylene used has a volume transition temperature of approximately 138° C., which is close to the volume transition temperature of the thermoset material after curing. Oxidized polytheylene is also desirable because it is in the solid state at the gelation temperature of the liquid thermoset, which is important to keep immiscible liquids from separating during processing.

Other thermoplastic polymer materials that may be suitable for use with liquid epoxy resins based on the softening temperature range and specific density (shown in parenthesis) are ethyl cellulose (157° C., 1.479), ethylene/ethyl cellulose (152° C., 0.93), hydroxyethyl cellulose (141° C., 1.39), methyl cellulose (150° C., 1.39), poly(p-tert-butylstyrene) (132° C.), poly(methacrylonitrile) (120° C.), poly(phenylene sulfide) (150° C., 1.36), polystyrene (129° C., 1.06), poly(4-vinyldiphenyl) (138° C.), styrene/maleic anhydride (122° C., 1.18), styrene/maleic anhydride (150° C., 1.22). One skilled in the art will appreciate that other thermoplastic materials that exhibit similar physical properties can be used in the invention.

The relative proximity of the respective volume transition temperatures of the polymer matrix and the thermoplastic material in preferred embodiments will vary depending upon the desired properties in the composition. For example, it is believed that volume transition temperatures generally within 20° C. of each other should be sufficient to provide a substantially continuous volume change for current limiting applications. However, as discussed earlier, the expected amount and rate of resistive heating of the composition and the desired performance should govern, at least in part, the selection of materials.

Crosslinking of the polymer matrix can be achieved chemically, thermally or by radiation. For example, U.S. Pat. No. 4,907,346 issued to Fang et al. provides methods of crosslinking polymers using radiation. It is preferred that the crosslinking be performed chemically to allow better control of the crosslinking process. The chemical compounds used for crosslinking can actively participate in the linkage or facilitate the linkage either directly or via another species.

Chemical compounds that are particularly effective crosslinking agents are anhydrides and peroxides. Anhydrides are the preferred compounds for use with epoxy resins, because anhydride crosslinking tends to be more site selective. For example, bisphenol A epoxy resins will tend to crosslink through ester linkages. Preferred crosslinking agents include 1-methyl tetrahydrophthalic anhydride, hexahydrophthalic anhydride (HHPA), dodecenyl succinic anhydride, phthalic anhydride, 1,4,5,6,7,7-hexachlorobicyclo-[2,2,1,]-5-neptene-2,3-dicarboxylic anhydride ("HET"), pyromellitic anhydride, trimellitic anhydride, and combinations ranging from about 15 to 120 parts per 100 parts polymer. Other crosslinking agents include borontrifluoride complexed, other Lewis acids, dicyandiamide and other amines and amides.

The most preferred crosslinking agent is 1-methyl tetrahydrophthalic anhydride ranging from about 80 to 115 or from 0.7–1.5 equivalents per equivalent of epoxy resin used. However, the desired final structural characteristics and PTC behavior of the composition will depend upon the amount of crosslinking agent used in the composition. As one skilled in the art will appreciate, the choice and amount of a crosslinking agents will vary with the choice of thermoset polymers, the amount of crosslinking desired and the application itself, as discussed, for example, in Chapters 8–12 of the "Handbook of Epoxy Resins" by H. Lee & K. Neville, (McGraw-Hill), the relevant portions of which are incorporated herein by reference.

The conductive material used in the invention can be conductive metals, carbon, semi-conductive metals, oxides or ceramics, conductively coated insulators and combinations thereof. The material does not have to be any particular size, shape or form; however, as discussed in the background, the physical characteristics of the material(s) selected will affect the extent of loading necessary to produce the desired conductivity. For example, in PTC applications, it is known that particles are generally better suited than fibers or flakes, because the shape of the particles makes it less likely that significant amounts of surface area will be in intimate contact, thereby increasing the likelihood of particle separation at the switching temperature of the polymer. Whereas, in applications where it is desirable to minimize the amount of conductive material in the conductive polymer, fibers and flakes will be more suitable than particles for the reasons stated above.

In the current preferred embodiment using a liquid epoxy resin, generally spherical nickel particles are used as the conductive material for high voltage applications. For lower voltage applications, it may be possible to use carbon or semiconductive materials, such as titanium diboride, in the composition. In many instances, the electrical properties of polymers are more compatible with carbon than with highly conductive materials, such as metals. Therefore, it may be desirable to employ carbon in high voltage applications, because the use of carbon should result in less degradation of the polymer at the polymer/conductive material interface. However, the problems of loading high volumes of carbon into the liquid polymers has limited high voltage applications of carbon in conductive polymers.

An arc suppressant may be included in the composition for use in high voltage applications. Arc suppressants are used to prevent polymer breakdown as a result of partial electrical discharges (arcs) that occur across voids in the conductive polymer. Voids are created during the processing of polymers in the liquid state. In the preferred embodiment for high voltage or other applications in which arcing may present a problem, arc controlling material is included, ranging from about 1 to 25% by weight of the conductive polymer. Suitable materials include magnesium hydroxide and, more preferably, alumina trihydrate.

Reaction controlling materials, such as accelerants, inhibitors and retardants may be used to maintain control of the crosslinking and curing processes. These materials allow cure times and gelation to be controlled to give optimized processing. The type of reaction controlling material used in the composition will be determined in most instances by the processing time for a particular component. For example, U.S. Pat. No. 4,137,275 issued to Smith, which is incorporated herein by reference, describes accelerants that are suitable for use with epoxy resins of the present invention. Other materials, such as 2-methylimidazole, were found to be effective reaction controlling material for producing desirable properties.

The following examples demonstrate methods of preparation and the utility of conductive polymer compositions of the invention in electrical devices and are not intended to limit the invention in any way.

Three different compositions were prepared using varying portions of an epoxy resin mixture having the following composition to form the thermoset polymer:

| | Parts wt. |
|---|---|
| Bisphenol A epoxy resin | |
| DER 332 (Dow Chemical Corp.) | 50 |
| Diglycidylether of neopentylglycol | 50 |
| 1-Methyltetrahydrophthalic anhydride | 105 |
| Lindex 1 (proprietary curing accelerator) (Lindau Chemical, Inc., Columbia, SC) | 0.1 |

The epoxy resin mixture was combined with oxidized polyethylene particles and generally spherical nickel particles in the relative proportions shown in the table below using a vacuum mixing method.

| Component | #1 (vol. %) | #2 (vol. %) | #3 (vol. %) | #4 (vol. %) |
|---|---|---|---|---|
| Thermoset Resin | 62 | 56 | 47 | 41 |
| Nickel | 19 | 19 | 19 | 25 |
| o-PE | 19 | 25 | 34 | 34 |
| Thickness (inches) | 0.088 | 0.111 | 0.183 | 0.157 |
| Resistivity Ω-cm | 0.027–0.031 | 1.71 | 2.97 | 0.016 |
| Resistance Ω | 0.0037 | — | 0.81 | 0.061 |

The samples were prepared by dispersing the oxidized polyethylene and the nickel particles in the resin mixture at room temperature. The oxidized polyethylene was discretely distributed in the resin as particles ranging in size from 45–125 microns. The nickel particles were approximately 2–10 microns. The samples were used to form cakes that were approximately 0.125 inches in thickness. The cakes were cured for two hours at 135° C. plus an additional sixteen hours at 150° C.

After the samples were cured, the top and bottom layers of the samples were removed resulting in a final sample thickness of approximately 0.06 inches. It should be noted that no extraordinary procedures were employed to maintain complete homogeneity in the samples prior to being cured. As such, the top and bottom layers had higher concentrations of oxidized polyethylene and nickel, respectively, than would be in the bulk sample. Therefore, the samples tested had a somewhat higher concentration of the matrix material than the initial ingredients.

A silver foil electrode was used to measure the room temperature resistance of the samples, shown in the table above. The electrode was placed in intimate contact on each side of the sample, a current in the range of 0.5–2.0 amperes was applied across the sample disk, and the voltage drop across the sample was recorded. A 4 point in-line probe was used to measure the resistivities of the sample.

Figure 2:
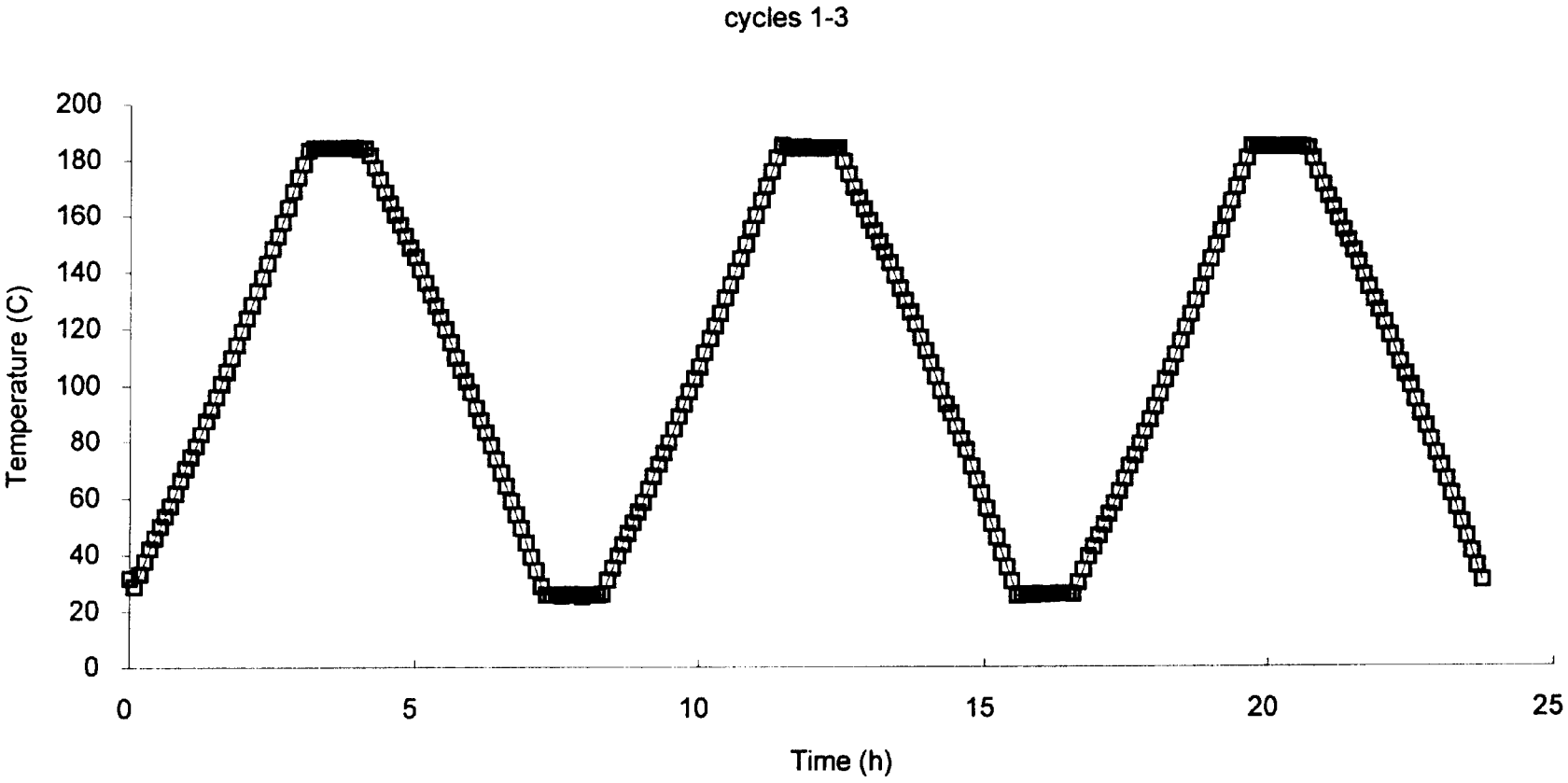
FIG. 2 shows the temperature profile used to thermally cycle components made from conductive polymer compositions of the present invention.
Figure 3:
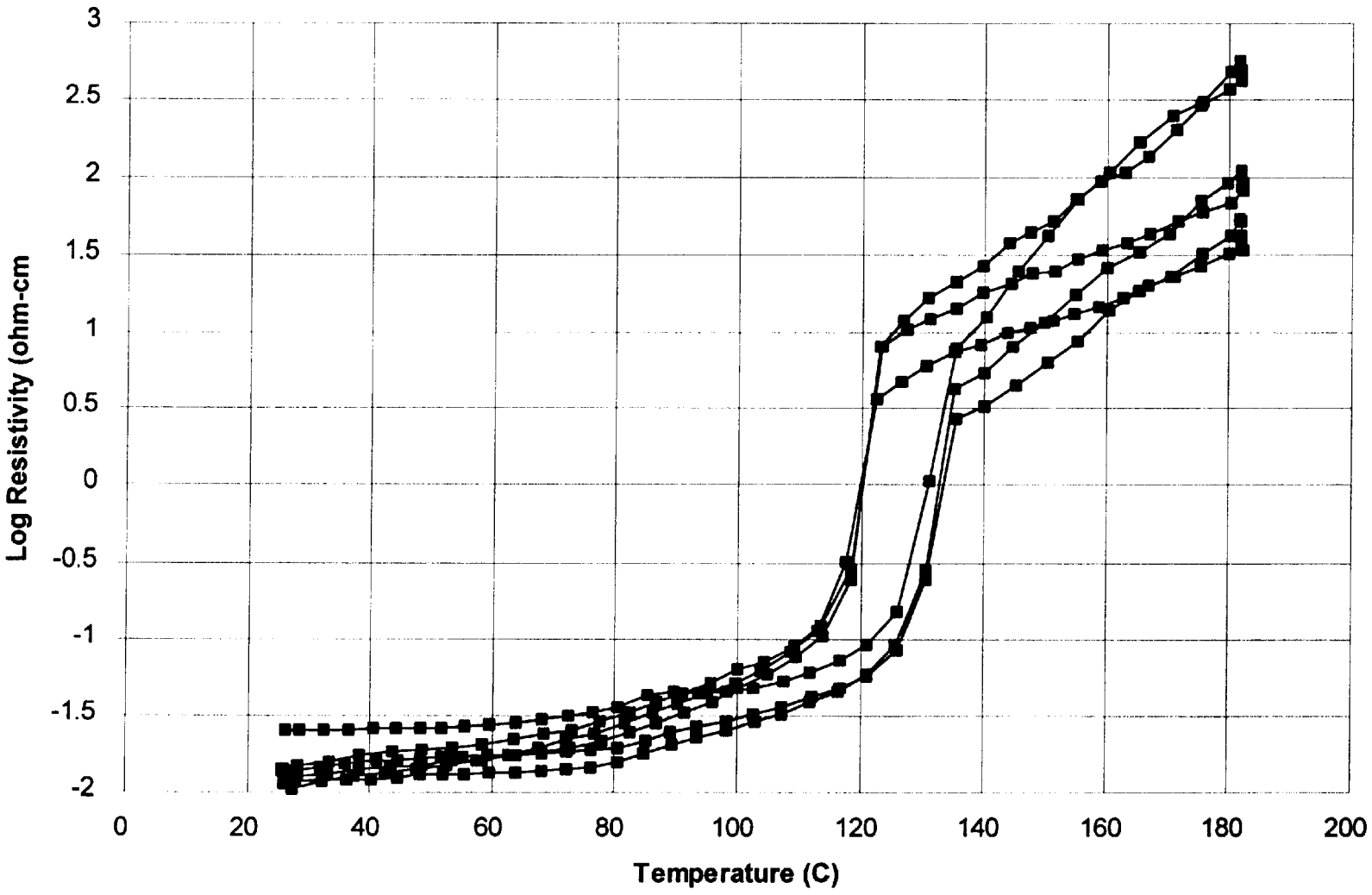
FIG. 3 shows the logarithm of the resistivity (ohm-cm) versus temperature (° C.) for each cycle shown in FIG. 2 for the formulation #1 composition.

The sample of formulation #1 was then subjected to thermal cycling testing between room temperature and 180° C., according to the temperature profile shown in FIG. 2. The direct current resistivity of the sample was measured using the 4-point probe and recorded every five minutes during testing. The results are shown in FIG. 3 and the table below provides the room temperature resistivities and the calculated PTC effect for each cycle. The PTC effect was calculated as the ratio of the resistivity at 180° C. to the resistivity at room temperature.

| Formulation 1 | | | | | | |
|---|---|---|---|---|---|---|
| Room Temperature Resistivity (Ω-cm) | | | | PTC Effect | | |
| Initial | Cycle 1 | Cycle 2 | Cycle 3 | Cycle 1 | Cycle 2 | Cycle 3 |
| 0.0253 | 0.0116 | 0.0138 | 0.0103 | $2.24 \times 10^4$ | $9.5 \times 10^3$ | $3.89 \times 10^3$ |

Figure 4:
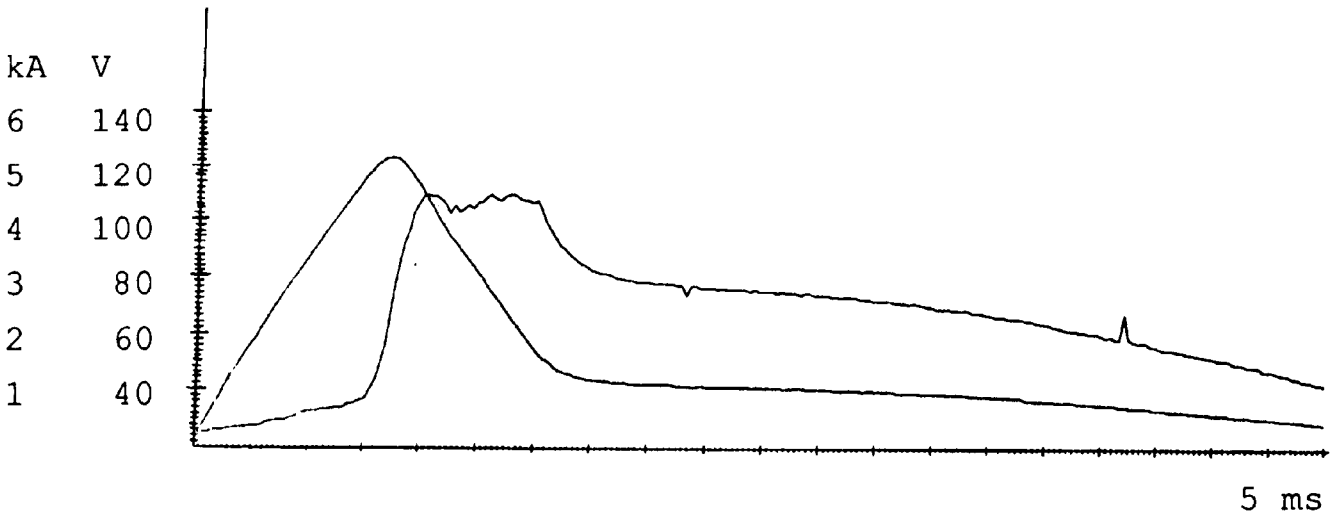
FIG. 4 shows the current and voltage versus time for the electrical switching test performed on a component made from formulation #1; and, FIG. 5 shows the resistance versus temperature for formulations 5–7.

Another sample was prepared from formulation #1 and electrical contacts were attached to the sample. The sample was placed in a circuit in parallel with a 100 milliohm shunt. A 12 kA current pulse was applied at 50 volts across the sample to test the current limiting capabilities of the material. The voltage and current flow through the shunt were measured as a function of time. As shown in FIG. 4, the sample limited the current passing through the sample to 3.913 kA after the pulse was applied. After the current pulse, the voltage/current traces decayed out to about 5 milliseconds at which time the test was terminated.

Other methods of mixing the components are also effective in preparing compositions having the desired electrical properties. In particular, twin-screw extrusion has been used to process these compositions. This mixing method improves the dispersion of the components and generally results in less settling of the particles during the final cure of the thermosetting resin. The improved mixing provides for somewhat different performance of the compositions than those prepared using the vacuum mixing method discussed above.

The formulations in the table below were prepared in a twin-screw extruder by feeding a mixture of the oxidized polyethylene and nickel in the main feed zone and injecting the liquid thermosetting resin in a later feed zone.

| Formulation | #5 | #6 | #7 |
|---|---|---|---|
| thermoset resin | 40 | 55 | 40 |
| nickel | 20 | 30 | 40 |
| o-PE | 40 | 15 | 20 |
| thickness | 0.19 | 0.23 | 0.23 |
| resistivity | 0.12 | 0.02 | 0.01 |
| resistance | 0.020 | 0.002 | 0.001 |
| PTC Effect | $2.5 \times 10^8$ | $2.3 \times 10^6$ | $1.6 \times 10^6$ |

By proper adjustment of the barrel temperature, screw speed, and feed rates, a homogeneous paste was extruded.

This paste was used to cast samples as previously described. Very little settling of the constituents was observed in this case. Moreover the paste could be extruded directly onto metal foils suitable for electrodes in the finished device.

Figure 5:
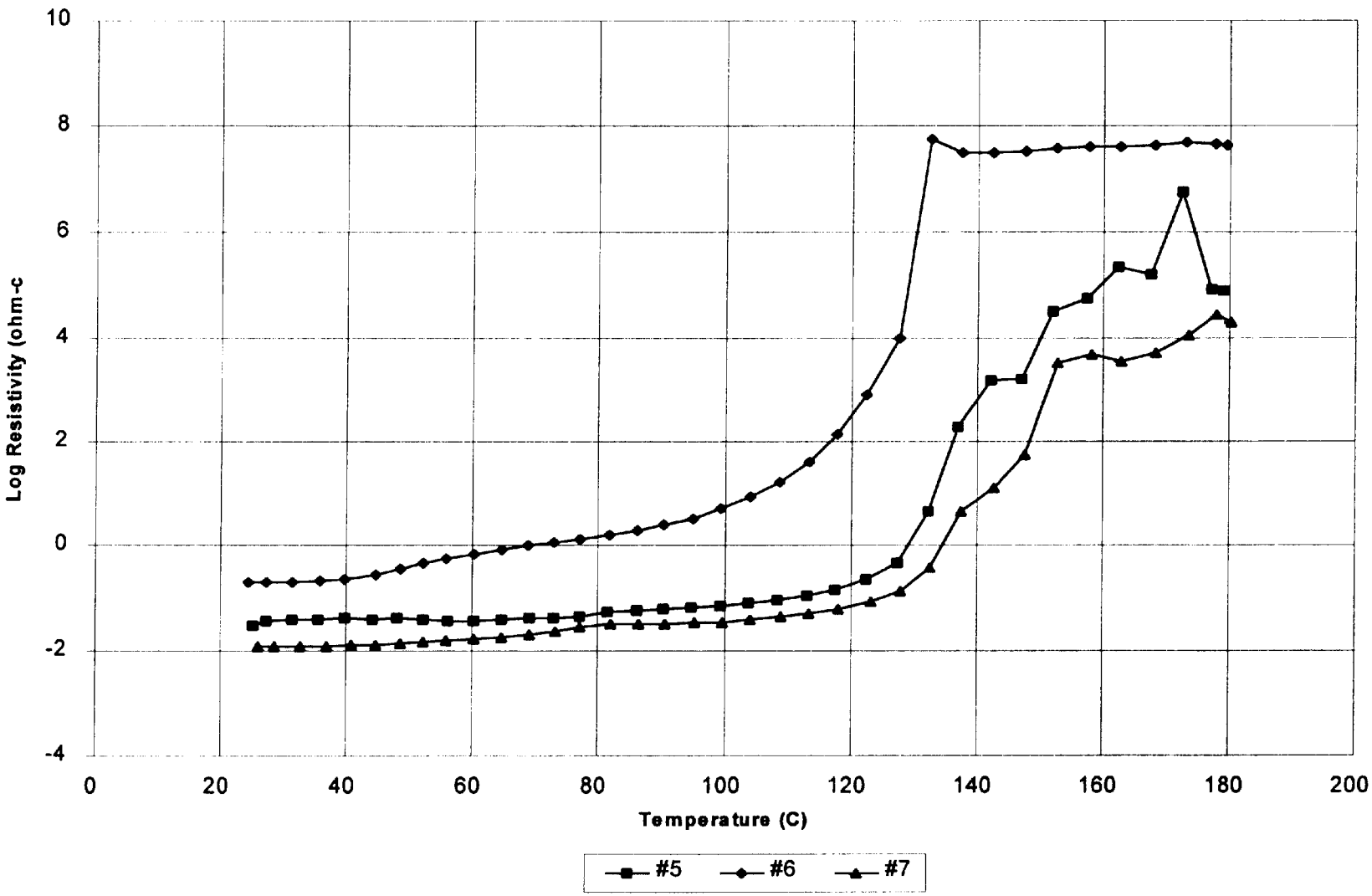

The electrical properties reported in the above Table were measured on partially cured (B-stage) samples. FIG. 5 shows the change in resistance when the samples are heated in an oven to evaluate the PTC characteristics of these samples.

Current preferred embodiments of conductive polymer compositions of the present invention employ a liquid epoxy resin as the starting material for the thermoset polymer matrix. However, the conductive polymer compositions may also be prepared by processing the polymer matrix material in the solid phase. Solid processing may allow for higher conductive filler loading by reducing or eliminating the problems associated with mixing high loadings of fillers with liquid polymers. Solid processing may also offer some advantages for fabricating large numbers of devices in a continuous manner.

The thermoset polymers may be in the solid phase at ambient conditions or at the initial phase of the process. For instance, the solid thermoset polymer can be processed into particulate form and mixed with carbon particles at a temperature below the polymer's softening point and subsequently heated to a liquid state to form the component. Also, some classes of polymers can be cured in stages, such that a polymer material could be partially cured to a solid phase and the curing process halted. The solid partially cured polymer material can then be further processed according to the method of the invention.

Solid processing of the composition may be desirable because the conductive material and additives, once mixed, do not separate in a solid conductive polymer mixture, thereby eliminating the need to continually mix the composition until the liquid thermoset polymer has solidified. Also, in solid processing, the conductive polymer composition does not have to be completed in a continuous process cycle. Interim products following the mixing stage can be stored and/or transported prior to final processing. The processing of a solid conductive polymer mixture alleviates problems in the prior art associated with the processing and handling of liquid mixtures, in addition to the benefits afforded by discrete processing steps.

Commercially available solid epoxy resins ranging from high melting point compositions, such as Epon 1009 (Shell Oil Company—Shell Chemical Division), to low melting point compositions such as DER 661 (Dow Chemical Corporation—Dow Resins Division), may be suitable in the present invention due to the thermal stability and ease of handling of these compounds. Other resins that may be suitable in the present invention include bisphenol F epoxies, novolac resins and cycloaliphatic epoxies, for example, 3,4-epoxy-6-methyl cyclohexyl-methyl 3,4 epoxycyclohexane-carboxylate (sold by Union Carbide Corp. as ERL 4221).

Those of ordinary skill in the art will appreciate that numerous modifications and variations can be made to specific aspects of the method and apparatus of the present invention without departing from the scope of the present invention. Such modifications and variations are intended to be covered by the foregoing specification and the following claims.

What is claimed is:

1. An electrically conductive polymer composition comprising:

A polymer matrix having a volume transition temperature and comprising at least one thermoset polymer;

thermoplastic material having a volume transition temperature; and, electrically conductive material dispersed in said matrix, wherein said thermoplastic material volume transition temperature is substantially equal to that of said polymer matrix.

2. The composition of claim 1 wherein said thermoplastic material has a crystalline structure and said within 20° C. of the volume transition temperature is polymer matrix.

3. The composition of claim 1 wherein said thermoplastic material has a crystalline structure and said volume transition temperature corresponds to a crystalline to amorphous transition temperature.

4. The composition of claim 1 wherein said polymer matrix volume transition temperature corresponds to a glass transition temperature.

5. The composition of claim 1 wherein said polymer matrix volume transition temperature corresponds to a matrix softening temperature.

6. The composition of claim 1 wherein said polymer matrix volume transition temperature corresponds to a resistance switching temperature of said composition.

7. The composition of claim 1 wherein said thermoplastic material is substantially immiscible in said matrix.

8. The composition of claim 1 wherein said electrically conductive material is dispersed in said thermoplastic material.

9. The composition of claim 1 wherein:

said thermoplastic material is comprised of oxidized polyethylene; and, said polymer matrix is comprised of a bisphenol A epoxy resin based thermoset polymer.

10. The composition of claim 1 wherein said polymer matrix is comprised of at least one thermoset polymer selected from the group consisting of epoxy resins, polyimides, unsaturated polyesters, silicones, polyurethanes, phenolic resins, cyanate esters and combinations thereof.

11. The composition of claim 1 wherein said polymer matrix is comprised of a bisphenol A epoxy resin based thermoset polymer.

12. The composition of claim 11 wherein said thermoplastic material is selected from the group consisting of ethyl cellulose, ethylene/ethyl cellulose, hydroxyethyl cellulose, methyl cellulose, poly(p-tert-butylstyrene), poly (methacrylonitrile), poly(phenylene sulfide), polystyrene, poly(4-vinyldiphenyl), styrene/maleic anhydride, styrene/maleic anhydride and combinations thereof.

13. The composition of claim 1 wherein said electrically conductive material is selected from the group consisting of carbon, electrically conductive metals, ceramics and combinations thereof.

14. The composition of claim 1 wherein said electrically conductive material includes at least one electrically conductive metal.

15. The composition of claim 1 wherein said polymer matrix further comprises additives selected from the group consisting of chemical crosslinking agents, reaction controlling materials, arc controlling materials, thermal conductivity altering materials and combinations thereof.

16. The composition of claim 15 wherein said chemical crosslinking agents are selected from the group consisting of peroxides, anhydrides, Lewis acids, carboxylic acids, phenolics, amide-imines, amines and combinations thereof.

17. The composition of claim 1 wherein:

said polymer matrix comprises a biphenol A epoxy resin based thermoset polymer;

said thermoplastic material comprises oxidized polyethylene particles; and, said electrically conductive material comprises nickel particles.

18. The composition of claim 11 wherein said thermoplastic material is discretely distributed in said matrix.

* * * * *